United States Patent [19]

Thompson et al.

[11] Patent Number: 4,881,392

[45] Date of Patent: Nov. 21, 1989

[54] HOT LEVELLER AUTOMATION SYSTEM

[75] Inventors: Noel E. Thompson, Mangerton; Richard Martin Johns, Balgownie; Gregory Rozmus, Figtree; George F. Voss, Bar Beach; William J. Edwards, Carey Bay; Peter J. Thomas, Adamstown, all of Australia

[73] Assignees: Broken Hill Proprietary Company Limited, Victoria; Industrial Automation Services Pty Ltd., New South Wales, both of Australia

[21] Appl. No.: 180,911

[22] Filed: Apr. 13, 1988

[30] Foreign Application Priority Data

Apr. 13, 1987 [AU] Australia ..... PI1404/87

[51] Int. Cl.[4] ..... B21D 1/02

[52] U.S. Cl. ..... 72/7; 72/13; 72/164

[58] Field of Search ..... 72/7, 9, 12, 13, 160, 72/164, 165

[56] References Cited

U.S. PATENT DOCUMENTS

| | | | |
|---|---|---|---|
| 3,574,279 | 4/1971 | Smith | 72/7 |
| 3,820,711 | 6/1974 | Economopoulos et al. | 72/7 |
| 3,940,598 | 2/1976 | Sekiguchi | 72/7 |
| 4,698,990 | 10/1987 | Petri et al. | 72/165 |
| 4,768,363 | 9/1988 | Yamashita et al. | 72/13 |

OTHER PUBLICATIONS

"The Levelling Process When Flattening Plate On Roller Levelling Machines", H. Kreulitsch et al., Bander, Bleche, Rohre, 1976, 17(11), 443–447.

*Iron-And Steelworks Engineering*, "Heavy Plate Levellers", F. A. Batty et al., Nov. 1965.

*Journal of Japan Society for Technology of Plasticity*, "Shape Correction of Steel Strip by Tension Leveller", Yoshisuke Misake et al., 1976.

*Primary Examiner*—Daniel C. Crane

*Attorney, Agent, or Firm*—Armstrong, Nikaido, Marmelstein, Kubovcik & Murray

[57] ABSTRACT

This invention relates to a method of, and apparatus for, controlling a levelling machine for metal plates and, more particularly, to control flatness in a plate mill hot leveller.

30 Claims, 10 Drawing Sheets

HOT LEVELLER AUTOMATION SYSTEM

FIELD OF THE INVENTION

This invention relates to a method of, and apparatus for, controlling a levelling machine for metal plates and, more particularly, to control flatness in a plate mill hot leveller.

BACKGROUND OF THE INVENTION

A common configuration of levelling machine has a set of work rolls, with axes parallel and displaced horizontally, which is mounted in a fixed frame and supported by larger diameter backup rolls in such a way as to minimise bending deflections. These deflections are caused by the large forces applied to the workpiece in the levelling operation. A second set of work rolls, mounted in an adjustable frame, has its rolls parallel to those in the first frame and offset so that the two sets of rolls may be intermeshed to create a workpiece path which causes repeated reverse bending as the workpiece is driven through the machine. A number of alternative arrangements are feasible for moving the workpiece through the leveller from pulling it through from the exit end, to driving one or more work rolls by speed-controlled electrical or hydraulic motors.

The prime function of the hot levelling equipment is to improve the flatness and surface finish of the rolled material (referred to as a pattern). During rolling, non-uniform thickness reductions in the transverse direction (typically in the range 0–0.2%) result in corresponding elongation variations which are manifested in the form of undesirable waves or buckles. End effects also produce flatness imperfections in the form of buckles or plate end curvature.

The improvement in flatness in the levelling equipment is achieved by passing the "buckled" or "wavy" pattern between a series of driven, intermeshing rolls which produce bending stresses in excess of the material yield strength. Small longitudinal strains occur preferentially in non-buckled regions and the net effect is to eliminate a significant proportion of the buckling present after rolling.

It has been found that to achieve the best results, a mathematical model of the process is necessary to predict the optimum machine settings for the hot leveller. This allows optimum flatness and avoids overloading of the machine elements or drive system. Because the theory of hot levelling is not well developed, a number of empirical correction factors, whose values are determined on the basis of experience, are preferably used in the model. Some automatic compensation for this potential source of error can be achieved by adapting the models during processing on the basis of comparisons made between predicted and measured quantities. This technique offers an extremely powerful tool for improving the prediction of optimum settings.

SUMMARY OF THE INVENTION

According to the present invention there is provided a method of controlling a hot leveller for metal plates having upper and lower work rolls mounted in upper and lower cartridge drive devices for driving the work rolls adjustment device for controlling the relative positions of the upper and lower work rolls. A computer controls the drive device and adjustment device, the method including the steps of inputing data to the computer relating to the (i) type of levelling required, (ii) the type of material of the plates, and (iii) the temperature and thickness of the plates; determining, in the computer, the number of passes of the plates through the leveller to achieve the levelling required by reference to stored data in the computer; calculating, in the computer using mathematical models of the leveller deflections and plate bending behaviour setting values for controlling the drive device and adjustment device; applying the setting values to the drive means and adjustment means; and passing a plate between the upper and lower work rolls for the number of passes to level the plate.

Preferably, the calculations are performed prior to the commencement of each levelling pass of the plate and the parameters are stored for use at appropriate times between successive passes.

It is further preferred that separate sets of values for the reference positions of the corners are calculated and stored for use during head-end threading and during mid-workpiece levelling. Preferably, further, the calculations include one or more of the following steps:

(i) calculation of yield stress of the plate during levelling, (ii) calculation of forces and torques on individual rolls, (iii) performing checks to test for head-end blockage and for the presence of sufficient frictional forces to ensure unhinded feeding of the plate into the head end of the leveller, (iv) calculation of compensation factors for elastic deflections in the rolls, the use of a temperature model for the plate to enable correct calculation of yield stress for the plate to be calculated and tests to be performed to ensure that overloading of the leveller does not occur.

The invention also provides a hot leveller for levelling metal plates. The leveller includes upper and lower work rolls mounted in upper and lower cartridges, a drive device for driving the work rolls, an adjustment device for controlling the relative positions of the upper and lower work rolls and a control device for controlling the drive device and the adjustment device. The control means including a first input device for inputing data relative to the type of levelling required and the material and selected dimensions of the plates, a second input device for imputing sensed temperatures of the plates, device for determining the number of passes of the plates through the leveller in order to achieve the levelling required, generating control signals, and the first and second control signal generating device for generating first and second control signals for controlling the drive device and adjustment device respectively.

It has been found that the leveller controlled in accordance with the invention can be used satisfactorily with plates having thickness varying over a range of 15:1. Previously levellers were effective only over a thickness range of approximately 10:1.

When levelling workpieces with tapered thickness profiles, a series of calculations are performed for representative points along the workpiece.

DESCRIPTION OF THE DRAWING

The invention will now be further described with reference to the accompanying drawing; in which.

DESCRIPTION OF THE PREFERRED EMBODIMENTS

Figure 1:
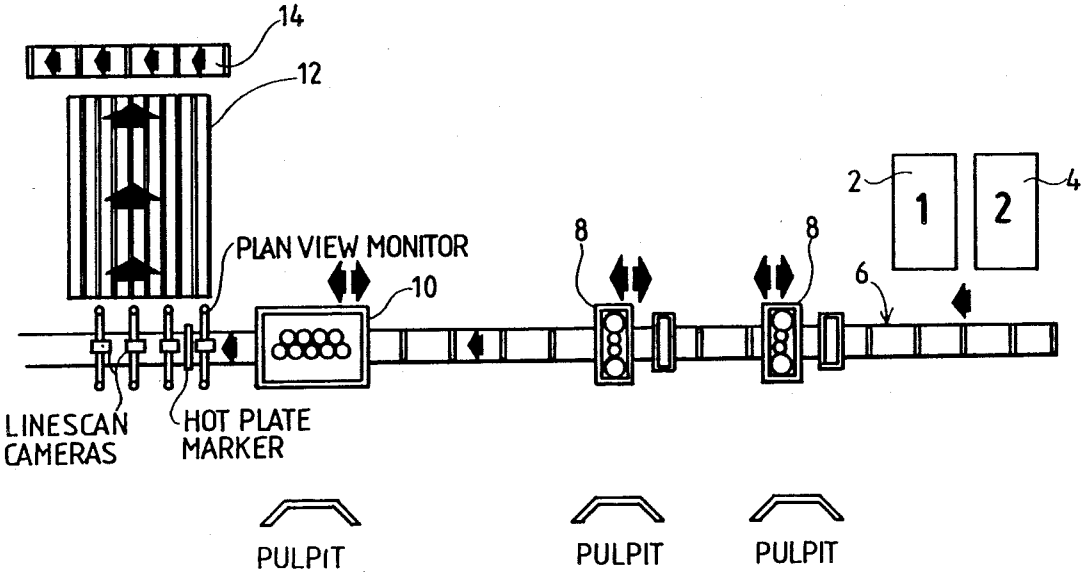
FIG. 1 is a schematic diagram of a plate mill complex.

The plate mill complex diagramatically illustrated in FIG. 1 shows plate reheating furnaces 2 and 4 which pass hot steel plates 72 (see FIG. 2) to a roller table 6. The roller table passes the plates to four high rolling mills 8 with detached edges. When the rolling of a pattern by the mills 8 is completed, the plates are then conveyed to a hot leveller 10. The pattern is passed one or more times through the leveller and positioned ready for transfer to a cooling bed 12. On the exit side of the cooling bed, the pattern is moved onto roller tables 14 for further processing such as cutting, dividing, cold levelling and marking.

Figure 7:
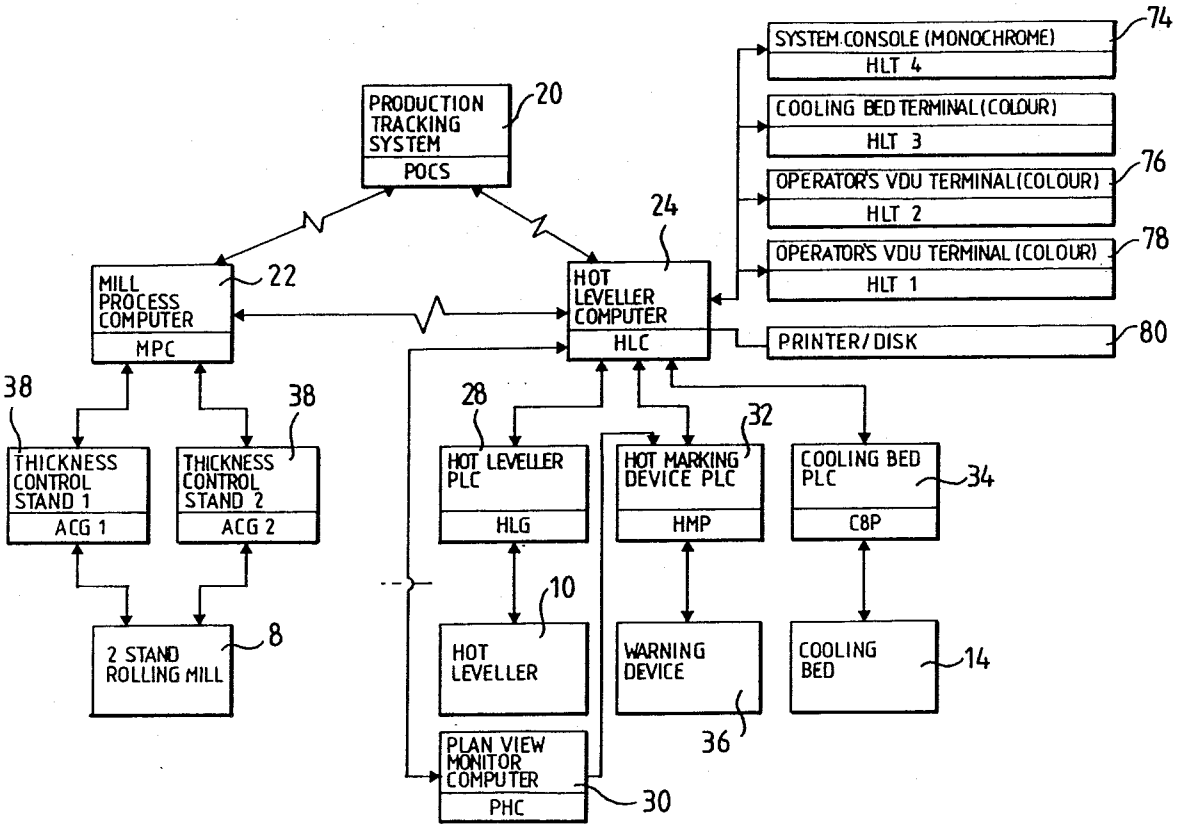
FIG. 7 shows a typical structure of a hot leveller computer system.

FIG. 7 shows in block diagram form a typical structure of a hot leveller computer system for controlling the plate mill complex. The overall mill complex structure is known and need not be described in detail. Generally speaking, the computer system operates at three different levels to control the plate mill complex. At the highest level, a production checking system computer 20 provides information on the processing requirements to each other processing stage and receives status information which enables it to dynamically keep track of the location of all workpieces 72, in the complex. At an intermediate level, specialised computers are provided for controlling parts of the complex. A mill process computer 22 is provided for controlling the rolling mills 8. A hot leveller computer 24 is provided for controlling the hot leveller 10. A cooling bed computer 26 is provided for controlling the cooling bed 14. The intermediate computers have communication links with the higher level tracking computer 20 and with each other. The intermediate computers also have communication links with the lowest level systems which directly control the plant equipment. The low level systems may comprise small computers or programmable logic controllers (PLCs) which are specifically designed for sequencing operations and simple control functions. The low level systems for the illustrated arrangement include a hot leveller machine control unit 28, a plan view monitor unit 30, a pattern marking unit 32 for a marking device 36, cooling bed control unit 34 and thickness control units 38 for the rolling mills 8. The hot leveller computer 24 may comprise a Digital Equipment PQP -11/73 with 512 kilobytes of memory coupled to a 31 megabyte disk storage unit (not shown). FIG. 7 also shows various peripherals coupled to the system. Output from the computer 24 is coupled to the hot leveller via the hot leveller machine control unit 28. In accordance with the invention, the hot leveller computer 24 executes programmes in accordance with the flow chart of FIG. 9 or 10 so as to calculate various parameters for setting up and functioning of the hot leveller 10.

The structure of the hot leveller 10 is illustrated in more detail in FIGS. 3 to 6. The leveller 10 comprises a substantial frame having a base 42, four upright posts 44 connected at their upper ends by a top connecting assembly 46. Fixedly mounted in the frame is a lower roll cartridge 48 which has five work rolls 50*a* to 50*e*. The lower work rolls are supported by sets of back-up rolls 52*a* to 52*f*. Each back-up roll set typically includes seven roll segments.

Figure 5:
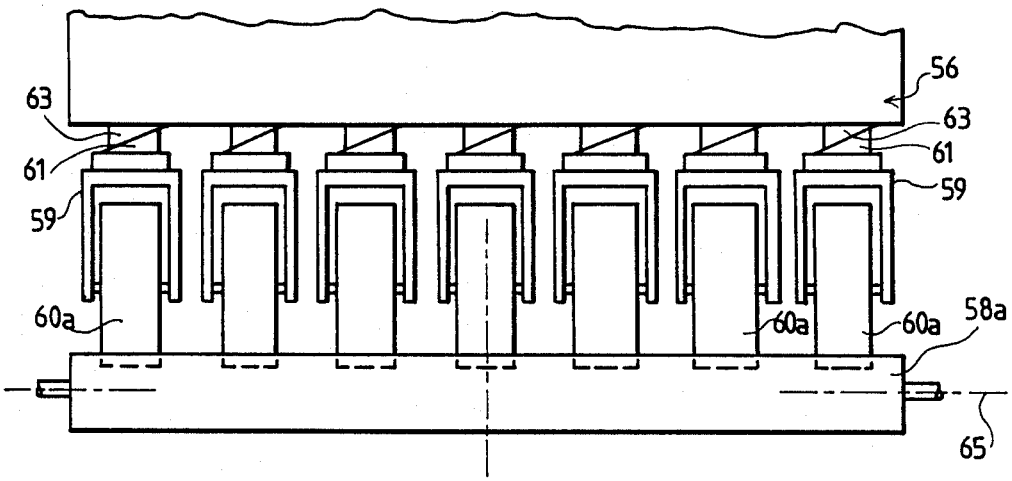
FIG. 5 is a shcematic side view of a work roll with back-up rolls.

The leveller includes an upper roll cartridge 56 which is movably mounted in the framework. Four upper work rolls 58*a* to 58*d*, supported by upper back-up rolls 60*a* to 60*e*, are supported in the upper cartridge 56. Each back-up roll is in seven segments as shown in FIG. 5. Each segment is carried by a yoke 59 which is coupled to a wedge 61 which engages a complementary wedge 63 mounted on the cartridge 56. Motor driven screws (not shown) are provided to move the yokes 59 so that the co-operating wedges will cause the segments to be altered in their vertical position with respect to the central axes of the work rolls 58*a* to 58*d*. The central axis 65 is shown for the roll 58*a* in FIG. 5. This enables the work rolls to be deflected into a particular shape for special treatment of a plate as shown by way of example in FIG. 6. The upper cartridge 56 includes entry and exit adjustor rolls 62 and 64, the function of which is to control the entry and exit angles of the workpiece or plate 72 which is being processed by the leveller. Typically the adjustor rolls have a diameter of 420 1 mm.

The upper roll cartridge 56 is supported by a sub-frame 66 which is positioned by four motor driven screws 68 located at each corner thereof for fixing the position of the sub-frame 66 with respect to the framework. The leveller includes four hydraulic rams 70 which can dynamically adjust the position of the upper roll cartridge 56 relative to the sub-frame 66. The position of the adjustor rolls 62 and 64 relative to the upper cartridge 56 can be adjusted by means of motor driven screws (not shown) at either end of each of the adjustor rolls, the motor driven screws acting on support bearing housings for the rolls.

Electric motors (not shown) are provided to drive the work rolls 50 and 58 as well as the adjustor rolls 62 and 64 via gear boxes and clutches. The electric motors provide the necessary power to deform the plates in the leveller and drive them through the leveller.

Figure 2:
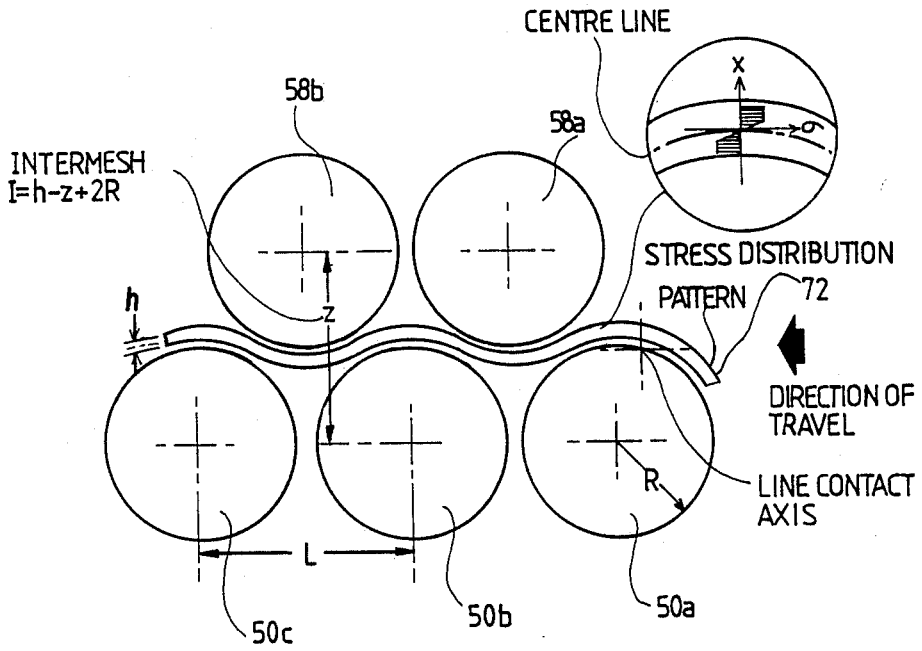
FIG. 2 diagramatically illustrates a typical hot leveller work roll geometry.
Figure 3:
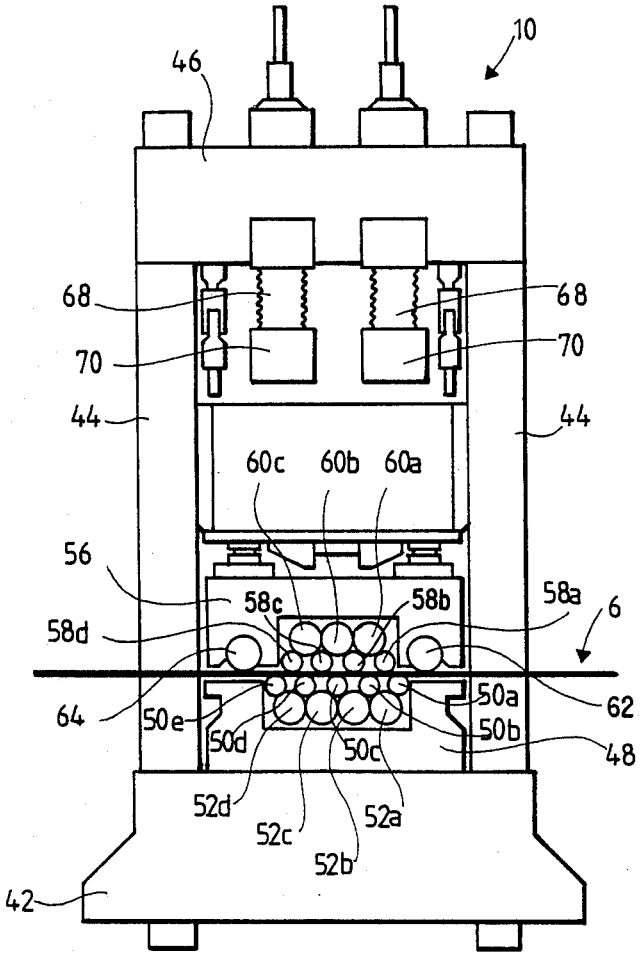
FIG. 3 is a schematic side view of a hot leveller.
Figure 4:
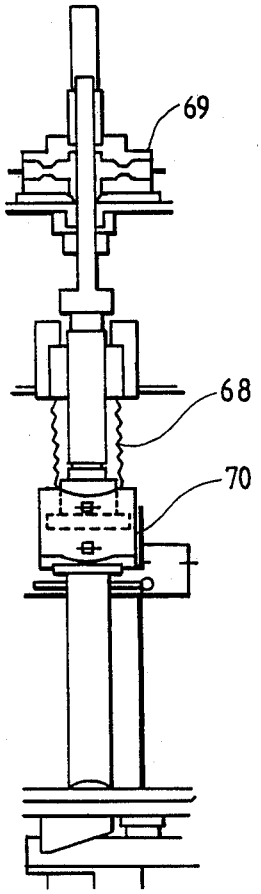
FIG. 4 is a more detailed view of part of the hot leveller.

The combined action of the screws 68 and hydraulic positioning rams 70 is to independently control the height of each corner of the upper roll cartridge 56 relative to the lower cartridge 48. The screws 68 are for making major adjustments which might be required from the set up calculations whereas the hydraulic rams 70 are for making smaller, dynamic changes which might be required during a pass. These settings therefore set a predetermined intermesh I between the upper and lower work rolls 50 and 58. FIG. 2 diagramatically illustrates some of the work rolls acting on the plate 72, the intermesh I being determined as follows:

$$I=h-Z+2R$$

where:

h is the thickness of the plate 72,

Z is the vertical distance between the centers of the work rolls 50 and 58, and R is the radius of the workrolls.

The setting of the intermesh determines the degree of bending and therefore levelling experienced by the plate 72 as it is driven through the leveller.

In a typical hot leveller, the work rolls 50 and 58 are 280 mm in diameter. Each of the work rolls is supported by five to seven of the back-up rolls segments which are typically 420 millimeters in diameter. The electric motors controlling the rolls are usually arranged in two groups which are independently operable. The first group acts on entry side rolls comprising lower work rolls 50*a* and 50*b* and upper work rolls 58*a* and 58*b*. The other group drives the exit side rolls comprising lower rolls 52*b*, 52*c* and 52*d* upper rolls 58*c* and 58 *d*. There is no mechanical link between the two parts of the drives other than through the plate 72 being levelled.

Work roll intermesh I is set by the adjustment of four screws 68 each acting on a corner of the sub-frame 66. The screws are divided into entry side and delivery side sets, each set driven by an independent, position controlled, DC motor via a generator 69. Each screw 68 is coupled to a ram 70 which comprises short stroke hydraulic ram with a 70 mm stroke. The functions of the hydraulic rams 70 are to:

(i) act as unjamming devices, (ii) allow threading of thin, high-strength material by clamping down after the head-end feeding of the plate 72 is completed ie, after the plate has passed the first pair of work rolls on the entry side.

(iii) provide dynamic framework stretch compensation by feedback to the position control system reference from load cells (not shown) on the framework, and (iv) enable tapered thickness plates to be levelled accurately by dynamically adjusting the roll positions, as the plates are levelled.

Figure 6:
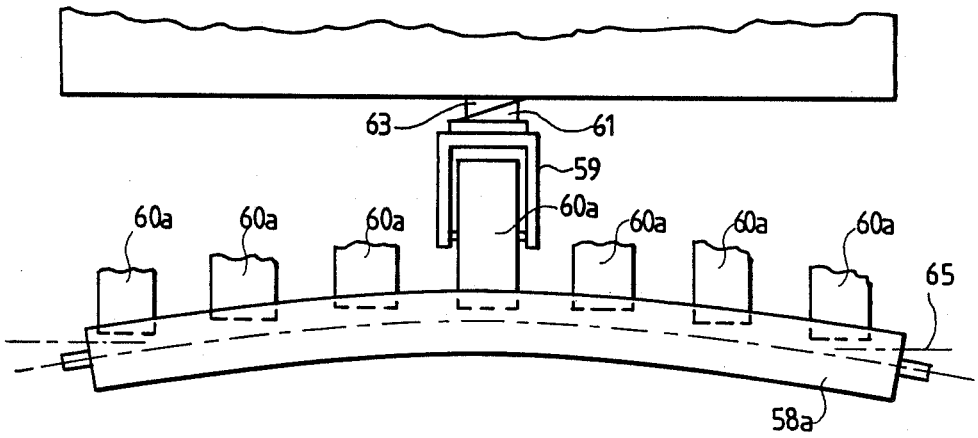
FIG. 6 is a schematic side view showing work roll crowning.

The work roll bending mechanism (not shown) for the work rolls 50 and 58 includes variable pitch screws which will adjust the relative support locations of the yokes 59 to produce a roll bending profile with a set amplitude. That is, the work roll axes may deflect under load to follow curved paths, defined by the positions of the backup roll yokes, as shown in FIG. 6.

A knockdown roll (not shown) is preferably located above the roller table 6 between the mill 8 and the entry side of the leveller 10 and has a hydraulic cylinder (not shown) to control its position. The function of this roll is to flatten raised plate front ends (sometimes called 'ski' or 'turn-up') should they occur. A high-pressure water descaling system header (not shown) is normally attached to the knockdown roll frame. A second header (not shown) is located below the passline.

The hot leveller computer 24 provides a number of supervisory control functions including:

(i) Communications to associated automation systems:

particularly important is the input of a primary data set related to the processing of the next pattern or plate 72 from the mill process computer 22. This data set typically consists of material type, mill exit temperature sensed by temperature sensors (notshown) and measured dimensions and type of levelling passes and special processing requirements.

(ii) Pacing of the leveller 10 and cooling bed 12:

this involves an adaptive estimation procedure for predicting the expected processing time for the next group of patterns to be processed.

(iii) Product tracking:

multiple plates are tracked from the mill, through the leveller 10, and across the cooling bed 12. At appropriate times, initialisation data is sent to the leveller 10, (for machine setup), to a plan view monitor 30, to a hot marking device 38, and to the cooling bed 12.

(iv) Leveller setup calculation:

when requested and in accordance with the invention, an adaptive algorithm calculates all the required machine settings which correspond to the primary data set and any adjustments entered by the operator via a system console 74. In the case of multipass levelling, calculations are performed automatically after each pass.

(v) Interactive operator interface:

using two colour VDUs 76 and 78 and a function button keyboard effective information exchange with the pulpit operation is achieved for process status displays and data entry.

(vi) Archival of processing information and technical report generation:

for each pattern processed, a record is created and stored on disk 80. The record preferably contains primary data, calculated settings, key measurements recorded during each pass, adaption parameter estimates and associated alarms and operator comments. An engineering report may subsequently be requested for a nominated group of patterns which presents all of the archived information in a concise, tabulated format.

Prior to the levelling of each pattern, a number of machine adjustments are made in the leveller 10 to achieve the optimum processing conditions. The settings required vary with product dimensions, material grade and temperature. There may also be some dependence upon the quality of pattern flatness prior to levelling. Because of the large number of parameters involved, and the fact that the optimum settings may vary with time as machine conditions or other process parameters vary, it is not feasible to store all the required settings for every combination of pattern dimensions, grade and temperature. The technique of the invention solves this problem by utilizing mathematical models which can represent the dependence of machine settings upon independent input variables such as thickness, width, grade, temperature and flatness. The algorithm which generates the machine settings as a function of the input variables is referred to as "the setup calculation".

The objective of the setup algorithm is to predict satisfactory settings for threading the head-end of the patterns into the leveller 10 and for levelling at maximum permissable speed taking into account operator trims and the results of a parameter adaption procedure. The predicted settings include the following parameters:

(i) head-end threading speed, ie when the plate end reaches roll 58*b*.

(ii) maximum levelling speed, (iii) tail-end exit speed, ie when the plate reaches the roll 50*c*, and (iv) corner position references for the corners of the upper roll cartridge 56.

After threading has been accomplished, the subsequent fully threaded operation may require different intermesh settings and speeds to those required for threading and the calculations are repeated for these conditions.

Because of the complex nature of the setup calculation, an explicit (once-through) procedure is not feasible and a certain degree of iteration is normally necessary. By performing the calculations in a particular order, it has advantageously found that the complexity of the iterative procedure can be minimized. This permits the use of lower capacity hardware and shorter periods for calculations.

Figure 8:
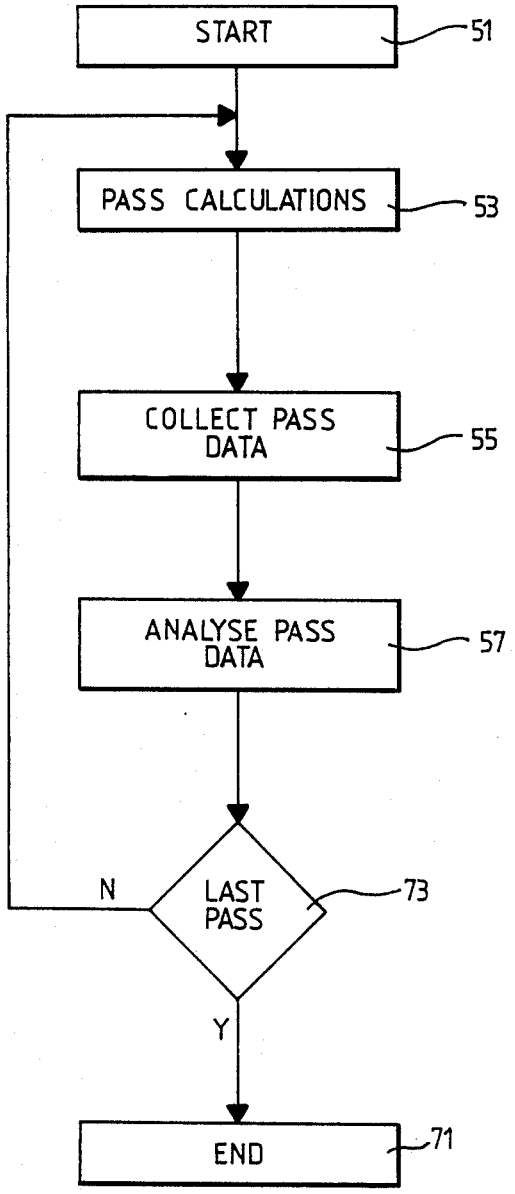
FIG. 8 is a flow chart for controlling the leveller of the invention.

FIG. 8 shows a flowchart for a supervisory programme of the hot leveller computer 24. It has a start box 51, which passes to a pass calculations box 53. The pass calculations are calculated in accordance with the flowchart illustrated in FIG. 9 or FIG. 10 and prior to the first pass of the plate through the leveller yield the set-up data. As the plate 72 passes through the leveller, data such as temperature, width and frame deflection of the leveller are gathered as indicated by step 55. The measured data is then input to the calculation programme of FIG. 9 or FIG. 10 to yield set-up data for a subsequent pass of the plate through the leveller. The programme then passes to a question box 73 which determines whether the pass which had just been completed is the last pass or not. If it is not, the programme then returns to the box 53 for insertion of the new data to calculate the set-up positions for the pass about to be undertaken. On the other hand, if it is the last pass, the programme passes to an end state indicated by box 71.

Figure 9:
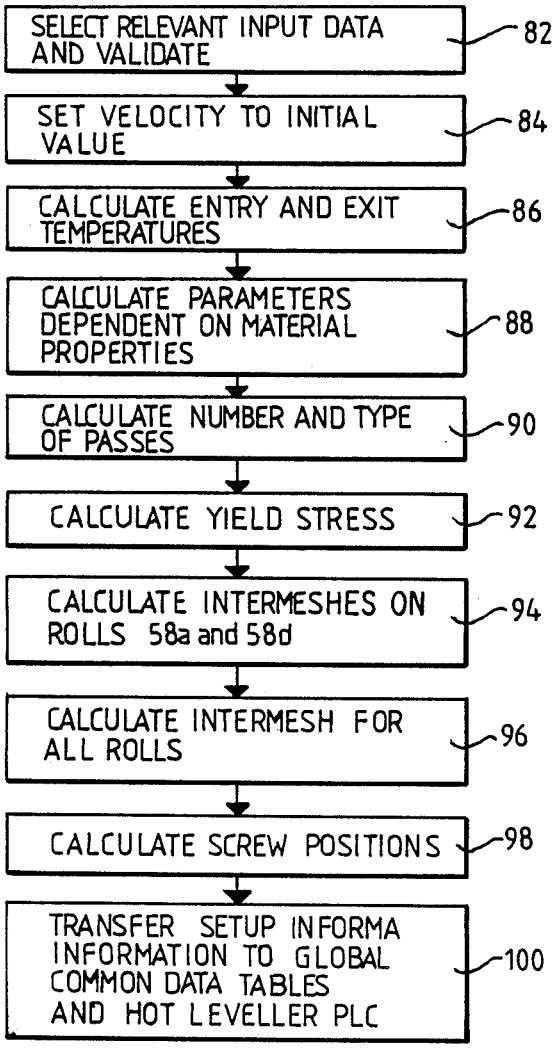
FIG. 9 is a flow chart which illustrates important logical steps taken in the calculation of set-up parameters for the leveller.

FIG. 9 illustrates in more detail an example of the pass calculations which are carried out in the box 53. The flowchart includes an input data selection step 82 which receives data input from an operator via the system console 74 or from a higher level computer such as the computer 20 or 22. The operator may input trim values for instance by requesting more levelling to be carried out on a particular plate because of a visually observed defect in the plate being presented to the leveller. Another example would be a raising of the adjuster roll 62 in order to accommodate a plate having a raised or slight ski front edge on the plate. In the step 82, the input values are subjected to validating tests to see whether they are within predetermined limits.

The programme then passes to a velocity setting step 84 which selects an initial rotational velocity of the work rolls 52 and 58, which determines the velocity of the plate 72. The initial rotational velocity is preferably selected near the middle of the range so as to give a plate velocity of about say 1 meter per second. The programme then passes to step 86 for calculation of the temperature of the plates at the exit of the hot leveller. The temperature of the plates can be readily measured at the exit of the mills 8 or at the entry of the leveller 10. Known equations are used to calculate the temperature drop of the plate as it passes through the leveller. The temperature of the plate in the leveller is important because the yield stress of the material is usually temperature dependent.

The programme then passes to step 88 in which a number of parameters are calculated which are dependent upon properties of the material. For instance, Youngs modulus is calculated, this parameter usually being temperature dependent. Further, Poissons ratio is also calculated.

The programme then passes to step 90 in which the number and type of passes of the plate through the leveller 10 is computed. The computation is based essentially upon operational rules and not upon mathematical modelling. For given inputs, stored tables are looked up to yield the number of passes and the type of pass. The type of pass refers to the depth of plastic deformation of the plates as a function of the thickness of the plates. Table 1 appended hereto, shows operational rules for extending the number of passes of the plate through the leveller and the type of passes. Table 2 shows typical strain ratios and yield ratios for various types of pass.

The programme then passes to step 92 in which the yield stresses are calculated. The prediction of levelling roll forces and torques requires an accurate knowledge of the material yield stress in plane strain. For most materials, the yield stress is a function of temperature, strain, strain rate and, in some cases, prior strain history. It will be assumed that, for the conditions encountered in hot levelling, the strain e and strain rate (de/dt) terms are relatively small and the yield stress k* is given by:

$$k^* = k_g k[[k_{y1} \cdot f_g(T)][1 + k_{y3} e][1 + k_{y4}(de/dt)] + k_{y2} + k_{yo}]$$

where e is the natural bending strain at the material surface, $k_{yo}$ is grade dependent and $k_{y1} - k_{y4}$ and $f_g(T)$ are constant for a particular grade group. A short term, grade independent yield stress correction k and a longer term grade group dependent term $k_g$ are also included. Grades are nominated to belong to one of 20 groups and each $f_g(T)$ function is common to all members of the group. To adjust for minor differences between members of a group, the yield stress offset term $k_{y0}$ is provided. The $f_g(T)$ function is always equal to 1.0 at a temperature of 650° C. so that the nominal yield stress of a material is given by $(k_{yo} + k_{y1} + k_{y2})$ at a temperature of 650° C. (neglecting the strain and strain rate contributions). Values of the function $f_g(T)$ are defined in Table 3 appended hereto at intervals of 50° C. Intermediate values are obtained by linear interpolation. Values of the group dependent constants $k_{y1}$ to $k_{y4}$ are defined in Table 4. The Young's modulus of each levelled material is required in subsequent analysis and is presented in Table 5 appended hereto for the same range of temperatures as used in Table 3.

The programme then passes to step 94 for calculation of the required intermesh on the first and last rolls **58*a* and 58*d* of the upper cartridge. A determination of the intermesh for these rolls determines the intermesh for the intermediate rolls 58*b* and 58*c*. Given the maximum strain, the maximum bending radius of curvature R' of the work rolls 50 and 58** and corresponding roll intermesh I may be calculated from model equations. These have the form:

$$R' = 0.5\ h/e^*$$

$$I = [L^2 e^*/(4h)] f(e^*, e_y)$$

where:

$e_y$ is the yield strain $k(e,e^*,t)/E(t)$,

E(t) is Young's modulus, a function of temperature,

L is the work roll pitch as indicated in FIG. 2, h is the pattern thickness as indicated in FIG. 2, and $f(e^*,e_y)$ is an algebraic function of the maximum surface strain e* and $e_y$ derived from levelling theory, as follows:

$$f(e^*,e_y) = [1 + 16(1 - Y^*)[5 - (1 - Y^*)^3]/[3(3 - (1 - Y^*)^2)^2] - [2 - Y^*]^2/[1 - (1 - Y^*)^2/3]].$$

where $$Y^*=1-ey/e^*$$

The plate will not make contact with the top of the work rolls but touch at some angle ahead of the vertical. Allowing for this gives a total roll intermesh of $$I_e=y+(R'+h/2)[3e^*y^{*2})/(2h(3-(1-y^*)^2))]^2.$$

These equations may be solved by substitution to obtain the intermesh as a function of the maximum strain or, alternatively, they may be solved iteratively to obtain the maximum strain as a function of intermesh.

It is important to recognise that the roll intermesh may differ from the amplitude of the pattern centerline peak-to-peak displacement by up to 3%.

The programme then passes to step 96 which calculates the intermesh for all of the work rolls. Based upon the leveller geometry and the intermesh settings for the entry and exit rolls calculated in step 94, the intermesh for the intermediate rolls may be calculated by interpolation. The maximum bending strains are then obtained from the intermesh equation which is the same as that used in step 94.

The programme then passes to step 98 which calculates the absolute position references from the intermesh settings, the material thickness data, machine deflections if sensed and the geometry of the leveller.

The programme then passes to step 100 for passing the set-up data to the hot leveller control unit 28, the higher level computers 20 and 22 and the system console 74.

Figure 10:
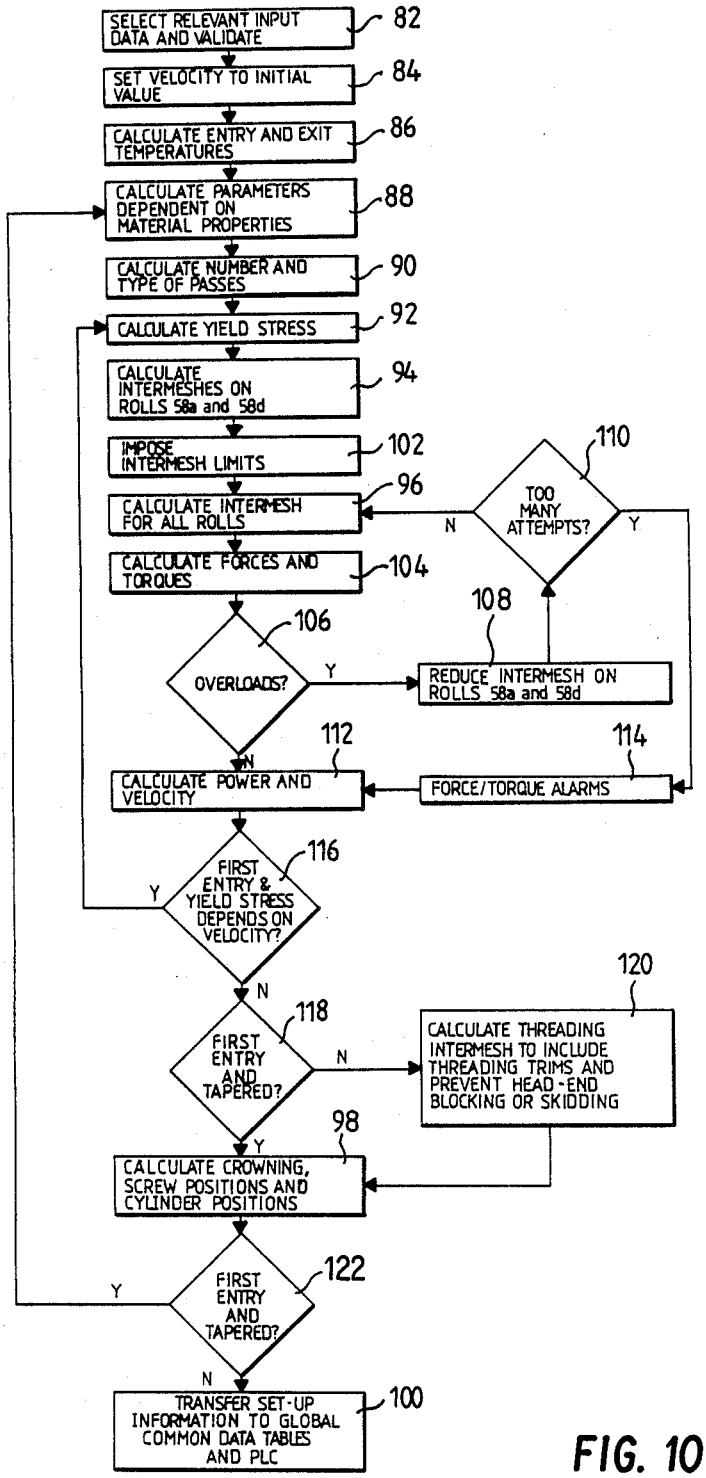
FIG. 10 is a flow chart for preferred steps in the set-up calculation.

The programme set out in the flowchart of FIG. 9 provide for very satisfactory control of the leveller and within a reasonable time. It is possible however to include enhancements of the programme and in this respect FIG. 10 illustrates a flowchart with additional programming steps to achieve a more optimum control of the leveller. In FIG. 10 the same reference numerals have been used to denote steps which are the same or similar to those of FIG. 9 and only the additional steps are described.

The preferred programme includes a step 102 between the steps 94 and 96 for interposing intermesh limits. the interposed limits are relevant if the calculated values are too high or too low. The lower limit is that the plate must contact the work rolls. The upper limit is set so as to avoid any rolling reduction action by the work rolls on the plate. The limits are calculated from the plate thickness and the known geometry of the work rolls.

The preferred arrangement includes step 104 after the step 96 for calculating the forces and torques on the work rolls.

Using the bending strains, material properties and dimensions, the individual roll forces $F_i$ and torques $G_i$ may be calculated from the following equations.

$$M_i=[1-e_y/e^*_i)^2/3]Wh^2k(e,\dot{e},t)/4,$$

$$F_i=2(M_{i-1}+2M_i+M_{i+1})/L,$$

$$G_i=e^*_i[1-e_y/e^*_i]^2WhRk(e,\dot{e},t)+G_{Li},$$

where:

W is the plate width, $M_i$ is the bending moment of work roll i, $G_{Li}$ is the torque loss of a work roll i, and R is the roll radius.

k (e,e,t)=yield stress of levelled material.

Slight modifications may be utilized at the entry and exit to take account of the boundary conditions induced by the adjuster rolls 62 and 64.

Summing the individual roll results enables the total force $F_T$ and torque $T_T$ to be determined for the entry and exit sections ($F_{Te}$ and $F_{Tx}$; $G_{Te}$ and $G_{Tx}$ respectively) and for the leveller as a whole. That is, $$F_T=F_2+F_4+F_6+F_8$$

(ie in the sum of forces on rolls 58*a*, 58*b*, 58*c* and 58*d*) where:

$$G_T = \sum_{i=1}^{n} G_i$$

where:

n is the number of rolls in the leveller.

The programme then passes to a leveller loading check step 106. In this step, if checks on the total force, torque or bearing loads indicate that limits are exceeded, then the maximum entry strain e* is reduced by lowering the intermesh for rolls 58*a* and 58*d*, as indicated by step 108. The programme then passes to step 96 via question box 110 which is included to prevent excessive time being spent in determining an optimum value for the intermesh. If the box 110 finds that there are too many attempts it will pass to step 112, which is further advanced in the programme, via step 114. The step 114 causes alarms to be generated to the operator warning that the intermesh is not optimum.

Step 112 is a leveller speed calculation step which determines the maximum work roll speed from the values of work roll torque which has been computed earlier and available drive power. This determines the maximum speed of operation, subject to the over-riding limit $V_m$ set by the operator, where Vm is the maximum horizontal speed of the plates 72 through the leveller. The maximum speed will be determined by the entry section which is invariably loaded more heavily than the exit section. The equation for calculating the maximum speed V' expressed in m/min is:

$$V'=60P^*_{we}R/(k_{g4}G_{Te})<V'<V_M<k_{lg}$$

where:

$k_{lg}$ is the rated maximum motor speed, $P^*_{we}$ is the available motor power for the entry section, $k_{g4}$ is the ratio of motor speed to roll speed, and $G_{Te}$ is the entry end torque at the motor shaft.

If the calculated motor speed is greater than base speed, then motor field weakening will be required. Tapered plates will be processed at base speed.

The head-end entry speed $V_e$ is less than or equal to V' depending on contstraints imposed by entry shock loadings, mill stretch amplitude and operational considerations.

$$V=k_{v1}[V-f_v(k_{v7})]+f_v(k_{v7})]/[1-k_{v2}S_e(F_{Te})],\ V_e \leqq V$$

The tailout speed $V_x$ is based on similar considerations.

$$V_x = k_{v3}[V - f_v(k_{v7})] + f_v(k_{v7})]/[1 - k_{v2} S_x(F_{Tx})],\ V_x \leqq V$$

where:

$k_{v7}$ is the maximum levelling thickness as defined in the unit specification.

$k_{v1}$ and $k_{v2}$ are constants, $\Delta S_e = F_{Te}/k_{si}$, ($k_{si}$ is typically 5 Nm/mm), and $\Delta S_x = F_{Tx}/k_{s2}$,($k_{s2}$ is typically 5 Nm/mm).

The programme then passes to question box 116 which determines whether it is the first entry of the programme to the box 116 and whether the material of the plate being processed in the leveller has a yield stress which is dependent upon volocity. If the answer to both of these questions is yes, the programme returns to step 92 to re-calculate various perameters in view of the adjusted value of volocity determined in step 112. For optimum results this loop would be repeated a number of times but for the sake of speed of processing a single return is selected. Thus, on the second entry of the programme to the step 116, it will pass to the next step 118.

The next step 118 is a question box which determines whether it is the first entry of the programme to that step and whether the plate being treated in the leveller is tapered. If the answer to both questions is yes, the programme will pass to step 98 for calculation of the screw positions. If on the other hand the answer to one or both of these questions is negative, the programme passes to step 120. In this step, trims are computed for the intermesh particularly with respect to the entry side of the leveller in order to prevent skidding of the plate relative to the roller 58*a* or jamming of the plate on contact with the second of the work rolls 50*b*. After the trims are computed, the programme returns to the step 98. The trim values are used to control the hydraulic rams 70 for dynamic control.

The programme then passes to step 122 which asks the same logical questions as step 118. If the answer to both questions is yes, the programme returns to step 88 to recompute values appropriate for a tapered plate. On the second pass the programme will proceed to step 100. Alternatively if the answer to one or both of the questions interrogated by step 122 is negative, the programme will pass to step 100.

Threading Check Step 120: Threading feasibility with respect to feeding torque and head-end blockage is checked and threading intermesh reduced until a satisfactory solution is obtained. The feeding torque constraint is associated with the maximum torque which may be transmitted by the frictional contact between the work rolls 50 and 58 and the plate 72 during the initial threading stage. If the entry intermesh is too high, then slipping will occur and effective threading is not possible without manual intervention. Similarly, excessive intermesh can cause the head end to foul the second bottom roll 50*b*. Approximate models to analyse these two situation enable an entry threading intermesh value to be determined which avoids operational threading problems.

The analysis of these phenomena is only approximate and therefore the limits are preferably set conservatively. If the checks fail, then a different machine setup will be employed for threading which involves a reduced entry intermesh. Shortly after threading of the first top roll 58*a*, the full speed intermesh settings may be restored.

Note that if the combined corrections for threading and frame stretch exceed the available travel of the hydraulic cylinders 70, then the threading conditions should not be altered, however, the final levelling entry and exit intermeshes should be constrained to the values permitted by the limit. This then requires a recalculation of leveller settings and operating conditions for the full speed condition.

The feeding torque check requires that $$Kl_7(F_1+F_2)R \geqq (G_1+G_2)$$

where:

F1, F2 are the forces on rolls 50*a*, 58*a* respectively

G1, G2 are the torques on rolls 50*a*, 58*a* respectively, and $Kl_7$ is the friction coefficient.

The head-end blocking check requires that the head end of the pattern strikes the surface of roll 50*b*. If a blocking angle b is positive, the pattern will block. The angle b is defined as follows:

$$b = \tan^{-1}((m_t - m_p)/(1 + m_t m_p)) - kz_1 \text{ radians,}$$

where:

$kz_1$ is the permitted excess

Machine Deflectoion Calculation Step 98

Two types of machine deflections are potentially important for the leveller setup calculation. The first involves the compensation of the position references for elastic strains which occur in the frame. These are calculated separately for the entry and exit positions as:

entry stretch:

$\Delta S_e = F_{Te}/k_{s1}$ exit stretch:

$\Delta S_x = F_{Tx}/k_{s2}$, where:

$\Delta S_e$ is the frame stretch at the entry end at full speed, $\Delta S_x$ = frame stretch at the exit end at full speed, $K_{s1}$ is the entry end frame stiffness, and $K_{s2}$ is the exit end frame stiffness.

A second machine deflection is allowed for and this involves the bending of the work rolls 50 and 58 when the backup support bearings are displaced relative to one another for the purpose of creating a non-parallel gap between the top and bottom work rolls when under load. A condition for satisfactory operation is that the backup rolls 52 and 60 up to and adjacent to the pattern edges should be in contact with the work rolls.

If the pattern width is W and the backup roll bearings required to support this width have their centres distant $L_w$ from the machine centre-line, then the maximum movement of the wedges 61 and 63 is required for which the work roll deflection is just sufficient to cause a cantilever deflection to touch backup rolls at two points $L_w$ apart.

Assuming a roll force due to levelling of F, then the deflection y is given by:

$$y = W^2 F L_w k_{s4}/(64 k_{s3})$$

where $K_{s3}$ is the product of Young's modulus and the moment of inertia of the work roll, $k_{s4}$ is a wedge limit conversion factor, in the range 62.5 to 125, $L_w$=length of each back-up roll, and W=width of plate 72.

Since this represents the difference in height, the maximum allowable centre wedge movement must not exceed the value:

$$S_{cm} \leqq k_{s11}.$$

where:

$S_{cm}$ is the maximum allowable wedge movement, and $k_{s11}$ is the maximum crowning wedge movement (typically 125 mm).

The step 98 may include calculations for work roll crowning. These calculations will provide control signals for moving the wedges 61 and 63 so as to enable a particular work roll crowning configuration to be achieved as the plate moves between the work rolls. FIG. 6 diagramatically illustrates an exaggerated crowning of one of the work rolls. The work roll crowning value is determined from one of the two input signals as follows:

(i) mill computer shape prediction $f_r$ (ii) operator roll crowning trim $C_o$.

The equation combining these factors is:

$$C=k_{s5}fr, \text{ if } C_o \text{ is zero,}$$

or else, $$C=C_o, \text{ if } C_o \text{ is non-zero.}$$

where:

C is the crown adjustment required $f_r$ is the quadratic component of transverse strain variation predicted by the mill computer 22, and $k_{s5}$ is a crown calculation constant (typically 1.0).

The conversion of the crown setting C to a wedge position reference $S_c$ is achieved by the equation:

$$S_c=k_{s6}+(k_{s7}/h+k_{s8})C.$$

where:

$k_{s6}$, $k_{s7}$ and $k_{s8}$ are crown calculation constants (typical values of which being 0.0, 0.0, and 1.25; respectively.

In order to protect the leveller the following limitations are imposed on crowning value:

1. Crowning is not permitted if the leveller is on a force limit or if the pattern thickness is too great ($h>ki_3$), where:

h is the pattern thickness, and $ki_e$ is the value above which there is no crowning (typically 100 mm).

2. Crowning is not allowed to exceed a specified percentage of the entry intermesh $$Sck_{s9}(W/k_{s10})^2/Im_e \leqq k_{il},$$

where:

$K_{s9}$ is the gap change due to crown calculation constant (typically 0.04), $k_{s10}$ is the maximum width of machine operation (typically 3100 mm);

$k_{i1}$ is the crowning intermesh limit check (typically 1.0), and $I_{me}$ entry intermesh on the first pair of work rolls 50*a* and 58*a*.

3. The pattern must make adequate contact with the work roll, i.e.

$$|S_c| \leqq Sc_m$$

The change in centre backup roll support position $S'_b$ in the vertical plane is given by:

$$\Delta S'_b=k_{s9}S_c.$$

The change in mean intermesh $S_b$ due to the movement of the backup roll support position is a function of width and $S'_b$, namely:

$$\Delta S_b=2[S'_b(w/k_{s10})^2]/3.$$

In step 102 the set up position references are determined from the previous calculations as follows:

Screw position references $$S_e=h-Im_1+\Delta S_b-\Delta S_e+K_{p2}$$

$$S_x=h-Im_9+\Delta S_b-\Delta S_x+Kp_2$$

If tapered plates are being processed, the screws should be set for the thinnest part of the plate.

Adjuster roll intermeshes:

$$Iae=Iaeo$$

$$Iax=Iaxo+0.444kx_6l_{ax}{}^2 2k^*/hE)Y_2$$

Adjuster roll positions relative to the top frame:

$$\theta=sin^{-1}((Im_2-Im_8)/l2_8)$$
$$Sae=(Im_2-Iae+lae\ sin\ \theta+kp_3)/\cos\theta$$

$$Sax=(Im_2-Iax-lax\ \sin\theta+kp_3)/\cos\theta$$

During threading the adjuster roll intermeshes relative to the top of the pattern are:

$$Iate = Iae - \Delta Stx - (l2_a + ae)(\sin\theta - \sin\theta')$$

$$Iatx = Iax - \Delta Stx - (lax - 2_9(\sin\theta - \sin\theta')$$

where:

$$\theta'=sin^{-1}(Im_1-\Delta Ste-Im_9+\Delta Stx(/(l2_9+l2_1).$$

Finally, the cylinder positions are calculated:

$$S_1=Se+kp_1+\Delta She_1$$

$$S_2=Se+kp_1+\Delta She_1$$

$$S_3=Sx+kp_1+\Delta Shx_1$$

$$S_4=Sx+kp_1+\Delta Shx_1$$

where:

$\Delta She_1$ and $\Delta Shx_1$ are gap changes required to accommodate thicker parts of a tapered plate. (when processing tapered plates, multiple sets of gap changes are provided; one pair per point on the pattern where the thickness changes.) Linear interpolation should be used to move from one set to another.

The position offsets $kp_1$ to $kp_5$ are included to compensate for offset definition displacement measurements.

Model parameter adaption calculations may be employed to predict the errors present in the more important model equations and provide smoothed estimates which will tend to minimise these errors over a number of patterns. For the case of a multipass leveller adaption may be performed on a pass-to-pass basis, to improve the next pass prediction and also on a pattern-to-pattern basis to improve the grade dependent component of the model errors.

Because of threading and tailout transients, and localised variations in temperature and thickness, measured process data for parameter estimation are preferably obtained while levelling a specified portion of the pattern length. For a leveller, the central $k_{a1}$ percent of the pattern is recommended provided that the material within a length $k_{a2}$ from each end is excluded and that a steady processing speed is maintained. If insufficient measurements are obtained which meet the requirement, adaption should be abandoned for that pass. No adaption however, is to be performed on patterns involving tapered thickness profiles because of the difficulty of obtaining meaningful measurements.

The major phases of the parameter estimation calculation are:

(i) determine when to initialise data collection,
(ii) collect measured data,
(iii) process measured data to check for steady state conditions and to—
(iv) produce averaged values for each required measurement,
(v) calculate derived variables from measured data, including specific forces, and;
(vi) motor output torques; and
(vii) calculate parameter estimates and process them through appropriate filters to generate adaption correction factors.

The parameters to be estimated are:

(i) yield stress error,
(ii) entry torque error,
(iii) exit torque error,
(iv) temperature error; and
(v) levelling time error.

Figure 11:
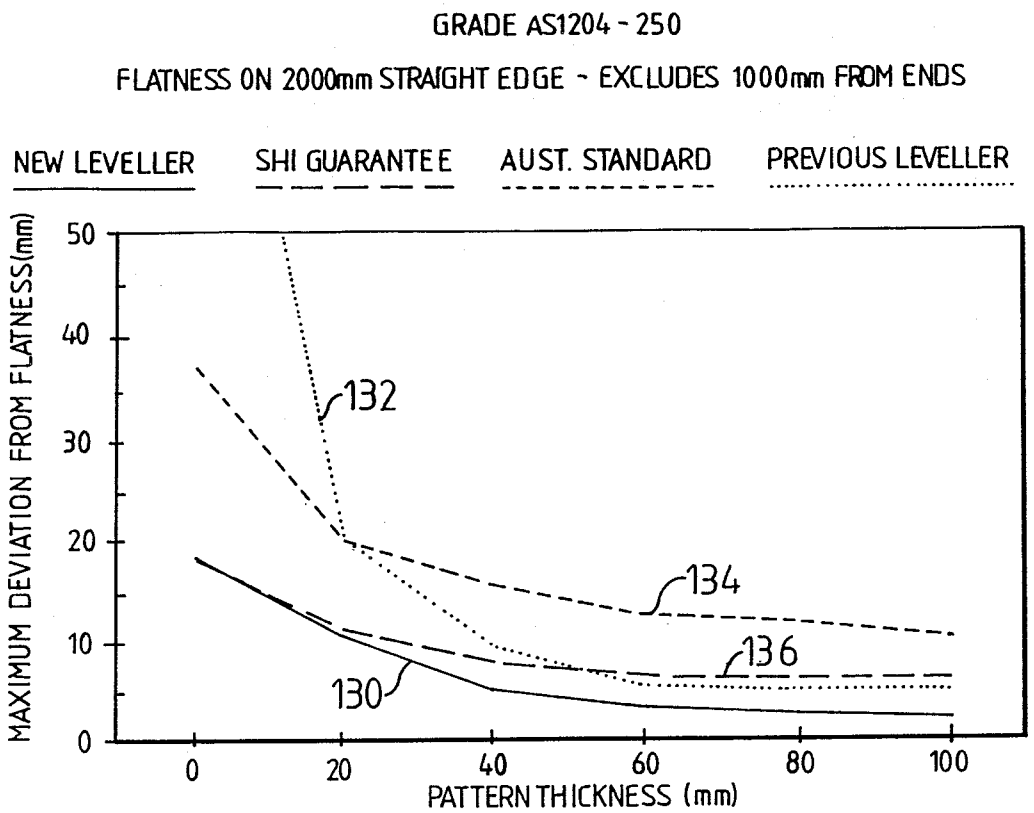
FIG. 11 shows graphically the leveller performance of the invention.

A preliminary indication of the performance of the leveller of the invention achieved is shown in FIG. 11 which compares the flatness measured before and after the leveller was installed, with the relevant Australian standard and guarantee figures. The line 130 represents the flatness of the leveller of the invention compared to a known leveller 132 and Australian Standard and Guarantee lines 134 and 136. The graph shows that the results of the leveller of the invention are superior to the other results for a full range of rolled products.

Significant further benefits are achieved in reduced turn-up and turn-down of the pattern ends and in improved surface finish due to a smoothing of the surface texture by the fine-ground leveller work rolls and the action of the descaling sprays.

In summary, the important novel features of the leveller of the invention are as follows:

(i) separate calculations are performed for predicting roll speed and intermesh settings on the workpiece head-end and the main body of the workpiece;
(ii) the calculation algorithm considers the actual physical dimensions and properties of the workpiece material;
(iii) adaption of the model is introduced to improve its accuracy;
(iv) operator adjustments can be included in the form of trims to the calculation results;
(v) a special form of yield stress model is used to represent the low strains and strain rates which occur in levelling;
(vi) a computationally efficient, iterative algorithm is employed;
(vii) forces and torques on individual rolls are predicted;
(viii) threading checks are made to test for head-end blockage and for the presence of adequate frictional force to ensure unhindered feeding of the head-end into the levelling machine;
(ix) compensation for elastic machine deflection is included in all calculations;
(x) a temperature mode for the workpiece is included so that the correct material yield stress can be calculated;
(xi) comprehensive tests are made to ensure that machine overloading does not occur.

Many modifications will be apparent to those skilled in the art without departing from the spirit and scope of the invention.

TABLE 1

| DEGREE OF LEVELING | | |
|---|---|---|
| ORIGINAL | ADDED PASSES | |
| FIRST PASS | PASS 2 | PASS 3 |
| super deep | deep | normal |
| deep | deep | normal |
| normal | deep | normal |
| ironing | ironing | ironing |

TABLE 2

| TYPE OF LEVELING | MAXIMUM STRAIN RATIO | YIELD RATIO |
|---|---|---|
| super deep | 6.25 | 0.84 |
| deep | 4.80 | 0.79 |
| normal | 3.81 | 0.74 |
| ironing | 2.50 | 0.60 |

strain ratio is defined as the ratio of surface strain divided by yield strain.

TABLE 3

| YIELD STRESS TEMPERATURE DEPENDENCE FUNCTION | | | | | | |
|---|---|---|---|---|---|---|
| TEMPERATURE | VALUE OF TEMPERATURE DEPENDENT FUNCTION $f_g(T)$ GRADE GROUP No. | | | | | |
| °C. | 1 | 2 | 3 | 4 | 5 | 6 |
| 300 | * | * | * | * | * | * |
| 350 | * | * | * | * | * | * |
| 400 | * | * | * | * | * | * |
| 450 | * | * | * | * | * | * |
| 500 | * | * | * | * | * | * |
| 550 | 1.56 | 1.97 | 1.06 | 1.06 | 1.64 | 1.69 |
| 600 | 1.21 | 1.45 | 1.04 | 1.04 | 1.32 | 1.34 |
| 650 | 1.00 | 1.00 | 1.00 | 1.00 | 1.00 | 1.00 |
| 700 | 0.80 | 0.81 | 0.96 | 0.96 | 0.75 | 0.84 |
| 750 | 0.68 | 0.66 | 0.93 | 0.93 | 0.62 | 0.67 |
| 800 | 0.61 | 0.45 | 0.91 | 0.91 | 0.52 | 0.59 |
| 850 | 0.55 | 0.28 | 0.82 | 0.82 | 0.45 | 0.57 |
| 900 | 0.49 | 0.26 | 0.78 | 0.78 | 0.38 | 0.55 |

TABLE 3-continued

| YIELD STRESS TEMPERATURE DEPENDENCE FUNCTION | | | | | | |
|---|---|---|---|---|---|---|
| TEMPERATURE | VALUE OF TEMPERATURE DEPENDENT FUNCTION $f_g(T)$ GRADE GROUP No. | | | | | |
| °C. | 1 | 2 | 3 | 4 | 5 | 6 |
| 950 | 0.48 | 0.23 | 0.68 | 0.68 | 0.30 | 0.49 |
| 1000 | 0.39 | 0.21 | 0.61 | 0.61 | 0.20 | 0.30 |
| 1050 | 0.35 | 0.18 | 0.54 | 0.54 | * | * |
| 1100 | * | 0.13 | 0.48 | 0.48 | * | * |
| 1150 | * | * | * | * | * | * |
| 1200 | * | * | * | * | * | * |

*Value not provided.
Note:
The value of $f_g(650)$ should always be 1.0.
Preliminary yield stress data is based on the following grades:

| Group | Grade |
|---|---|
| 1 | Carbon steel (250 MPa) |
| 2 | Carbon steel (350 MPa) |
| 3 | Stainless steel (austeritic) |
| 4 | Stainless steel (ferritic) |
| 5 | 1042/1060 |
| 6 | BIS 21 |

TABLE 4

| YIELD STRESS FUNCTION CONSTANTS FOR EACH GRADE GROUP | | | | |
|---|---|---|---|---|
| GRADE GROUP No. | CONSTANT (MPa) | | | |
| | $k_{y1}$ (MPa) | $k_{y2}$ (MPa) | $k_{y3}$ (—) | $k_{y4}$ (—) |
| 1 | 70.00 | 7.50 | 10.00 | 0.32 |
| 2 | 175.00 | −7.50 | 8.00 | 0.29 |
| 3 | 99.00 | 29.00 | 7.90 | 0.24 |
| 4 | 52.50 | 9.00 | 4.80 | 1.00 |
| 5 | 235.06 | 124.11 | 0.00 | 0.00 |
| 6 | 235.06 | 223.23 | 0.00 | 0.00 |
| 7 | 0.00 | 0.00 | 0.00 | 0.00 |
| 8 | 0.00 | 0.00 | 0.00 | 0.00 |
| 9 | 0.00 | 0.00 | 0.00 | 0.00 |

TABLE 5

| YOUNG'S MODULUS TEMPERATURE DEPENDENCE FUNCTION | | | | | | | | | |
|---|---|---|---|---|---|---|---|---|---|
| TEMPERATURE | YOUNG'S MODULUS (GPa) GRADE GROUP No. | | | | | | | | |
| °C. | 1 | 2 | 3 | 4 | 5 | 6 | 7 | 8 | 9 |
| 300 | 192.6 | * | 189.0 | 217.4 | * | 186.3 | * | * | * |
| 350 | 189.1 | * | 185.8 | 212.8 | * | 181.5 | * | * | * |
| 400 | 185.5 | * | 182.6 | 208.2 | * | 176.7 | * | * | * |
| 450 | 182.0 | * | 179.4 | 203.6 | * | 171.9 | * | * | * |
| 500 | 178.4 | * | 176.3 | 199.1 | * | 167.2 | * | * | * |
| 550 | 174.8 | * | 173.1 | 194.5 | * | 162.4 | * | * | * |
| 600 | 171.3 | * | 169.0 | 189.9 | * | 157.6 | * | * | * |
| 650 | 167.7 | * | 166.7 | 185.3 | * | 152.8 | * | * | * |
| 700 | 164.2 | * | 163.6 | 180.7 | * | 148.0 | * | * | * |
| 750 | 106.6 | * | 160.4 | 176.1 | * | 143.2 | * | * | * |
| 800 | 157.0 | * | 157.2 | 171.5 | * | 138.4 | * | * | * |
| 850 | 153.5 | * | 154.0 | 166.9 | * | 133.7 | * | * | * |
| 900 | 149.9 | * | 150.9 | 162.3 | * | 128.9 | * | * | * |
| 950 | 146.4 | * | 147.7 | 157.7 | * | 124.1 | * | * | * |
| 100 | 142.8 | * | 144.5 | 153.1 | * | 119.3 | * | * | * |
| 1050 | 139.2 | * | 141.3 | 148.5 | * | 114.5 | * | * | * |
| 1100 | 135.7 | * | 138.2 | 143.9 | * | 109.7 | * | * | * |
| 1150 | 132.1 | * | 135.0 | 139.2 | * | 104.9 | * | * | * |
| 1200 | 128.6 | * | 131.8 | 134.7 | * | 100.2 | * | * | * |

We claim:

1. A method of controlling a hot leveller for metal plates, said hot leveller having upper and lower work rolls mounted in upper and lower cartridges, a drive means for driving the work rolls, an adjustment means for controlling relative positions of the upper and lower work rolls, and a control means for controlling the drive means and adjustment means, said method including the steps of:

inputting data to the control means relating to (i) type of levelling required, (ii) type of material of the plates, and (iii) temperature and thickness of the plates;

determining the number of passes of the plates through the hot leveller to achieve the levelling required based on the data input to the control means;

determining setting values for controlling the drive means and adjustment means based upon leveller deflection and plate deflection;

applying the setting values to the drive means and adjust means; and passing a plate between the upper and lower work rolls for said number of passes to level the plate.

2. A method as claimed in claim 1 including the step of assigning a predetermined initial value to a determined rotational velocity of the work rolls and subsequently determining yield stress of the plates and the work roll intermeshes.

3. A method as claimed in claim 2 including the steps of determining the yield stress of the plates determining the work roll intermeshes which is a function of said yield stress, and using said work roll intermeshes to determine said setting values for the adjustment means.

4. A method as claimed in claim 3 including the step of sensing the temperature of the plate prior to entry into the leveller and determining entry and exit temperatures of the plate, and using the determined entry and exit temperatures where appropriate when calculating said work roll intermesh.

5. A method as claimed in claim 4 including the step of determining Youngs modulus and Poissons ratio for said plates as a function of temperature.

6. A method as claimed in claim 5 including the step of determining the intermeshes for the work rolls at the entry and exit of the leveller, interposing intermesh limits and then determining intermediate intermeshes for the work rolls which are intermediate of the work rolls at the entry and exit of the leveller.

7. A method as claimed in claim 6 including the step of determining forces on said work rolls; determining torques on said work rolls; and comparing the determined values of said forces and torques with predetermined maximum values to determine if an overload is predicted.

8. A method as claimed in claim 7 wherein if an overload is detected, the method includes the step of reducing the determined intermeshes for the work rolls at the entry and exit of the leveller by a predetermined amount and repeating said steps of determining intermediate intermeshes, determining forces and torques, and said comparing said determined values to determine if an overload is predicted.

9. A method as claimed in claim 8 including the step of setting a time limit for the processing time of said repeated steps and bypassing said repeated steps if the time limit is exceeded.

10. A method as claimed in claim 9 including the step of producing a warning signal when said time limit is exceeded.

11. A method as claimed in claim 8 including the step of determining a maximum velocity of the work rolls from the determined torques and known values of power ratings of motors in the drive means for driving the work rolls.

12. A method as claimed in claim 11 including the step of inputting stress-velocity data relative to whether or not the material of the plate is such that its yield stress is a function of work roll velocity; checking said stress-velocity data to determine if the yield stress is a function of velocity; and, if the yield stress is a function of velocity, returning to said step of determining the yield stress to redetermine various parameters using said maximum velocity of the work rolls.

13. A method as claimed in claim 12 including a step of limiting the number of times the programme is returned to said step of determining yield stress.

14. A method as claimed in claim 13 wherein the upper cartridge includes exit and entry adjuster rolls, second drive means for driving the adjuster rolls and second adjustment means for adjusting the position of the adjuster rolls relative to the upper cartridge and wherein the method includes the step of determining whether the plate is required to be tapered or not, and if it is not, determining threading intermesh settings to control said second adjustment means to prevent blocking or skidding of the plate at the entry adjuster and work rolls.

15. A method as claimed in claim 14, wherein, if the step of determining whether the plate is required to be tapered or not reveals that the plate is to be tapered, determining Youngs modulus and Poissons ratio.

16. A hot leveller for levelling metal plates, said hot leveller including upper and lower work rolls mounted in upper and lower cartridges, a drive means for driving the work rolls, an adjustment means for controlling relative positions of the upper and lower work rolls and a control means for controlling the drive means and the adjustment means, said control means comprising:

first input means for inputting data relative to a type of levelling required and material and selected dimensions of the plates;

second input means for inputting sensed temperatures of the plates;

means for determining the number of passes of the plates through the hot leveller in order to achieve the levelling required; and first and second control signal generating means for generating first and second control signals for controlling the drive means and adjustment means respectively.

17. A hot leveller as claimed in claim 16 including means for assigning a predetermined initial value to a determined rotational velocity of the work rolls.

18. A hot leveller as claimed in claim 17 including yield stress means for determining the yield stress of plates and an intermesh means for determining work roll intermeshes, said intermesh means being responsive to yield stress values generated by said yield stress means.

19. A hot leveller as claimed in claim 18 wherein the second input means includes a temperature sensing means for sensing the temperature of the plates prior to entry in the hot leveller and a temperature determining means for generating temperature signals representative of the temperature of the plate at the entry and exit of the leveller.

20. A hot leveller as claimed in claim 19 including parameter generating means for generating Youngs modulus and Poissons ratio for said plates as a function of temperature.

21. A hot leveller as claimed in claim 20 wherein the intermesh means produces intermesh signal values for the work rolls at the entry and exit of the hot leveller, said hot leveller including intermesh limiting means for limiting the intermesh values for the work rolls at the entry and exit of the leveller and wherein the intermesh means generates intermesh values for the work rolls which are intermediate of the work rolls at the entry and exit of the leveller.

22. A hot leveller as claimed in claim 21 including force means for generating force signals indicative of forces on the work rolls, said hot leveller further including torque means for generating torque signals representative of the torques on said work rolls, said leveller further including comparing means for comparing the force and torque signals to predetermined levels to determine if there are overloads.

23. A hot leveller as claimed in claim 22 including intermesh reducing means for reducing the value of the intermesh signal if an overload is detected and returning the reduced value of the intermesh value to said intermesh means.

24. A hot leveller as claimed in claim 23 including limiting means for limiting the number of times the intermesh reducing means returns reduced values of intermesh signals to said intermesh means.

25. A hot leveller as claimed in claim 24 including means for producing a warning signal when said limiting means is operated.

26. A method as claimed in claim 23 including maximum velocity means for generating signals indicative of the maximum rotational velocity of the work rolls from torque signals produced by said torque means.

27. A hot leveller as claimed in claim 26 including yield stress checking means for determining whether the yield stress of the plate is a function of said velocity, said yield stress checking means being operable, if the yield stress is a function of velocity, to return an updated velocity signal to said yield stress means.

28. A hot leveller as claimed in claim 27 wherein the upper cartridge includes exit and entry adjuster rolls, second drive means for driving the adjuster rolls and second adjustment means for adjusting the position of the adjuster rolls relative to the upper cartridge, and wherein the control means is operable to adjust said second adjustment means to prevent blocking or skidding of the plate at the entry adjuster roll and the work rolls adjacent to the entry of the leveller.

29. A method of controlling a hot leveller for metal plates, said hot leveller having upper and lower work rolls mounted in upper and lower cartridges, a drive means for driving the work rolls, an adjustment means for controlling relative positions of the upper and lower work rolls, and a control means for controlling the drive means and adjustment means, said method comprising the steps of:

(a) inputting a levelling signal, representative of a type of levelling required, to said control means;

(b) inputting a material signal, representative of a type of material required, to said control means;

(c) inputting a temperature signal, representative of a temperature of the plates, to said control means;

(d) inputting a thickness signal, representative of a thickness of the plates, to said control means;

(e) generating a pass signal, indicative of the number of passes of the plates needed to achieve the levelling required, in response to the levelling, material, temperature and thickness signals, said data being used to determine said pass signal;

(f) generating a plurality of setting value signals by processing said levelling, material, temperature and thickness signals;

(g) setting the drive and adjustment means in response to said setting value signals;

(h) passing a plate between the upper and lower work rolls for a number of passes as determined by said pass signal.

30. A hot leveller for levelling metal plates, said hot leveller including upper and lower work rolls mounted in upper an lower cartridges, a drive means for driving the work rolls, an adjustment means for controlling the relative positions of the upper and lower work rolls and a control means for controlling the drive means and the adjustment means, said control means comprising:

first input means for inputting signals indicative of a type of levelling required, a material and selected dimensions of the plates;

second input means for inputting a signal indicative of a sensed temperature of the plates;

means for determining the number of passes of the plates through the leveller in order to achieve the levelling required based upon said signals from said first and second input means; and first and second control signal generating means for generating first and secnd control signals for controlling the drive means and adjustment means respectively based upon said signals from said first and second input means.

* * * * *